US011262106B2

(12) United States Patent
Akaiwa et al.

(10) Patent No.: US 11,262,106 B2
(45) Date of Patent: Mar. 1, 2022

(54) REFRIGERATION CYCLE APPARATUS

(71) Applicant: Mitsubishi Electric Corporation, Tokyo (JP)

(72) Inventors: Ryota Akaiwa, Tokyo (JP); Shinya Higashiiue, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 150 days.

(21) Appl. No.: 16/321,281

(22) PCT Filed: Sep. 13, 2016

(86) PCT No.: PCT/JP2016/076969

§ 371 (c)(1),
(2) Date: Jan. 28, 2019

(87) PCT Pub. No.: WO2018/051409

PCT Pub. Date: Mar. 22, 2018

(65) Prior Publication Data

US 2019/0195539 A1 Jun. 27, 2019

(51) Int. Cl.
*F25B 13/00* (2006.01)
*F25B 6/02* (2006.01)
(Continued)

(52) U.S. Cl.
CPC ..... *F25B 13/00* (2013.01); *F25B 5/00* (2013.01); *F25B 5/02* (2013.01); *F25B 6/02* (2013.01);
(Continued)

(58) Field of Classification Search
CPC ..... F25B 13/00; F25B 2313/0233; F25B 2313/02543; F25B 2313/02531
See application file for complete search history.

(56) References Cited

U.S. PATENT DOCUMENTS

2003/0079873 A1* 5/2003 Kuroda ..... B60H 1/00907 165/202
2007/0157650 A1* 7/2007 Takegami ..... F25B 13/00 62/230
(Continued)

FOREIGN PATENT DOCUMENTS

JP 10170081 A * 6/1998
JP H10-170081 A 6/1998
(Continued)

OTHER PUBLICATIONS

Kokichi, Air Conditioner, 1996, Full Document (Year: 1996).*
(Continued)

*Primary Examiner* — Elizabeth J Martin
*Assistant Examiner* — Nael N Babaa
(74) *Attorney, Agent, or Firm* — Posz Law Group, PLC

(57) ABSTRACT

Provided is a refrigeration cycle apparatus capable of achieving an improvement in heat exchange performance during a heating operation and during a cooling operation, while suppressing increases in manufacturing cost and volume required for packaging. The outdoor heat exchanger and the outdoor heat exchanger are connected in parallel to the indoor heat exchanger via the branch portion. The flow path switching device includes a first port, a second port, and a third port. The first port is connected with a third refrigerant flow path. The second port is connected with the outdoor heat exchanger. The third port is connected with a fourth refrigerant flow path. The second port is configured to switch between a state in which the second port is connected to the first port and a state in which the second port is connected to the third port.

13 Claims, 13 Drawing Sheets

(51) Int. Cl.

| | |
|---|---|
| ***F25B 5/02*** | (2006.01) |
| ***F25B 6/04*** | (2006.01) |
| ***F25B 5/00*** | (2006.01) |
| ***F25B 41/26*** | (2021.01) |

(52) U.S. Cl.
CPC ..... *F25B 6/04* (2013.01); *F25B 41/26* (2021.01); *F25B 2313/0233* (2013.01); *F25B 2313/02531* (2013.01); *F25B 2313/02533* (2013.01); *F25B 2313/02543* (2013.01); *F25B 2313/02731* (2013.01); *F25B 2400/0411* (2013.01); *F25B 2600/2507* (2013.01)

(56) References Cited

U.S. PATENT DOCUMENTS

| | | | | |
|---|---|---|---|---|
| 2009/0183867 | A1* | 7/2009 | Bales | F28F 9/0209 165/299 |
| 2011/0259551 | A1* | 10/2011 | Kasai | F25B 41/45 165/100 |
| 2012/0118533 | A1* | 5/2012 | Jang | F28F 27/02 165/96 |
| 2015/0208549 | A1* | 7/2015 | Shedd | F28F 13/02 165/104.27 |
| 2016/0040896 | A1 | 2/2016 | Hong et al. | |
| 2017/0370627 | A1 | 12/2017 | Takenaka et al. | |

FOREIGN PATENT DOCUMENTS

| | | | |
|---|---|---|---|
| JP | H11-037587 | A | 2/1999 |
| JP | 2006-308166 | A | 11/2006 |
| JP | 2012-107857 | A | 6/2012 |
| JP | 2015-117936 | A | 6/2015 |
| WO | 2016/113851 | A1 | 7/2016 |

OTHER PUBLICATIONS

International Search Report of the International Searching Authority dated Dec. 6, 2016 for the corresponding international application No. PCT/JP2016/076969 (and English translation).
Extended European Search Report dated Sep. 11, 2019 issued in corresponding EP patent application No. 16916194.0.
Office Action dated Mar. 24, 2020 issued in corresponding JP patent application No. 2018-538988 (with English translation).
Office Action dated Sep. 21, 2021, issued in corresponding European Patent Application No. 16916194.0.

* cited by examiner

REFRIGERATION CYCLE APPARATUS

CROSS REFERENCE TO RELATED APPLICATION

This application is a U.S. national stage application of International Application No. PCT/JP2016/076969, filed on Sep. 13, 2016, the contents of which are incorporated herein by reference.

TECHNICAL FIELD

The present invention relates to a refrigeration cycle apparatus, and more particularly to a refrigeration cycle apparatus capable of switching the flow of refrigerant in a heat exchanger serving as a component, between a parallel flow and a serial flow.

BACKGROUND

Generally, in a heat pump apparatus such as an air conditioner, and a car air conditioner, when a heat exchanger is used to cool air, the heat exchanger is called an evaporator. In this case, refrigerant (for example, fluorocarbon refrigerant) flowing within the heat exchanger flows into the heat exchanger in the state of a gas-liquid two-phase flow, that is, a mixture of gas refrigerant and liquid refrigerant whose densities differ by tens of times. In the refrigerant in the state of a gas-liquid two-phase flow (two-phase refrigerant) having flowed therein, mainly the liquid refrigerant absorbs heat from the air and evaporates. Thus, the two-phase refrigerant changes its phase to gas refrigerant, and flows out of the heat exchanger as single-phase gas refrigerant. Since the heat is absorbed from the air as described above, the air is cooled and becomes cool air.

Further, when a heat exchanger is used to warm air, the heat exchanger is called a condenser. In this case, single-phase gas refrigerant having a high temperature and a high pressure discharged from a compressor flows within the heat exchanger. The single-phase gas refrigerant having flowed in the heat exchanger turns into supercooled single-phase liquid refrigerant by latent heat and sensible heat (the latent heat is generated when heat is absorbed from the single-phase gas refrigerant by the air and thereby the refrigerant condenses and changes its phase to single-phase liquid refrigerant, and the sensible heat is generated when the liquefied single-phase refrigerant is supercooled). The supercooled single-phase liquid refrigerant then flows out of the heat exchanger. Since the air absorbs the heat, the air is warmed and becomes warm air.

In a conventional heat pump, the heat exchanger has been handled to be used as both the evaporator and the condenser described above, by a simple cycle operation and a reverse cycle operation in which refrigerant flows in the reverse direction. Accordingly, when a refrigerant flow path is branched into three, for example, and the refrigerant flowing within the heat exchanger flows through a plurality of refrigerant flow paths in the heat exchanger in parallel, the refrigerant generally flows within the heat exchanger in parallel in both cases in which the heat exchanger is used as an evaporator and as a condenser.

However, when the heat exchanger is used as a condenser, it is effective to use the heat exchanger in a state in which the number of branches in the refrigerant flow path is decreased and the refrigerant has a fast flow velocity, in order to exhibit the performance of the heat exchanger as efficiently as possible. When the heat exchanger is used as an evaporator, on the other hand, it is effective to use the heat exchanger in a state in which the number of branches in the refrigerant flow path is increased and the refrigerant has a slow flow velocity. This is because heat transfer, which depends on the flow velocity of the refrigerant, governs the performance for the condenser, whereas reduction in pressure loss, which depends on the flow velocity of the refrigerant, governs the performance for the evaporator.

As a technique for a heat exchanger corresponding to the characteristics of an evaporator and a condenser, there is proposed a refrigeration cycle apparatus including a flow path switching unit which allows refrigerant to flow through a plurality of flow paths (a first flow path and a second flow path) in parallel when a heat exchanger is used as an evaporator, and allows the refrigerant to flow through the plurality of flow paths in series when the heat exchanger is used as a condenser, as described for example in Japanese Patent Laying-Open No. 2015-117936 (PTL 1).

PATENT LITERATURE

PTL 1: Japanese Patent Laying-Open No. 2015-117936

However, the technique described in PTL 1, in which the number of refrigerant flow paths in the heat exchanger is increased and decreased, has a problem that it requires a plurality of refrigerant flow path switches on a refrigerant circuit, and thus causes increases in manufacturing cost and volume required for packaging the apparatus.

SUMMARY

An object of the present invention is to provide a refrigeration cycle apparatus capable of achieving an improvement in heat exchange performance during a heating operation and during a cooling operation, while suppressing increases in manufacturing cost and volume required for packaging.

A refrigeration cycle apparatus in accordance with one embodiment of the present invention includes a refrigerant circuit which includes a compressor, a first heat exchanger, an expansion valve, and a second heat exchanger, and in which refrigerant circulates. The second heat exchanger includes a first refrigerant flow path and a second refrigerant flow path. The first refrigerant flow path and the second refrigerant flow path are connected in parallel to the first heat exchanger via a branch portion. The first refrigerant flow path includes a first end portion, and a second end portion located opposite to the first end portion. The refrigerant circuit includes a flow path switching device, a third refrigerant flow path connecting the first end portion and the compressor, and a fourth refrigerant flow path connecting the second end portion and the branch portion. The flow path switching device includes a first port, a second port, and a third port. The first port is connected with the third refrigerant flow path. The second port is connected with the second refrigerant flow path. The third port is connected with the fourth refrigerant flow path. In the flow path switching device, the second port is configured to switch between a state in which the second port is connected to the first port and a state in which the second port is connected to the third port.

According to the refrigeration cycle apparatus in accordance with the present invention, the flow of the refrigerant in the first refrigerant flow path and the second refrigerant flow path of the second heat exchanger can be switched between a parallel flow and a serial flow using one flow path switching device. Therefore, a refrigeration cycle apparatus capable of improving heat exchange performance during a heating operation and during a cooling operation can be implemented at low cost and in a volume-saving manner.

DETAILED DESCRIPTION

Figure 1:
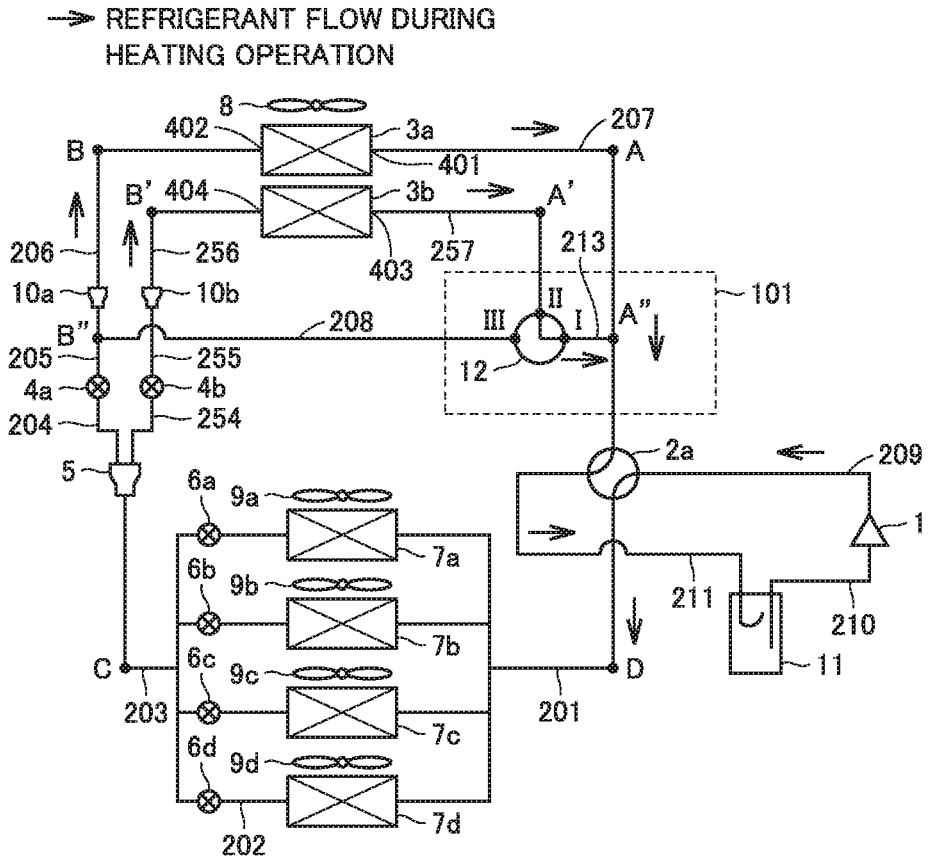
FIG. 1 is a schematic view showing a refrigerant flow during a heating operation in a refrigeration cycle apparatus in accordance with a first embodiment of the present invention.

Hereinafter, embodiments of the present invention will be described with reference to the drawings. In the drawings below, identical or corresponding parts will be designated by the same reference numerals, and the description thereof will not be repeated. Further, in the drawings below including FIG. 1, the relation in size among constituent members may be different from the actual relation. Furthermore, forms of components described in the entire specification are merely exemplary, and are not limited to these descriptions.

First Embodiment

<Configuration of Refrigeration Cycle Apparatus>

Figure 2:
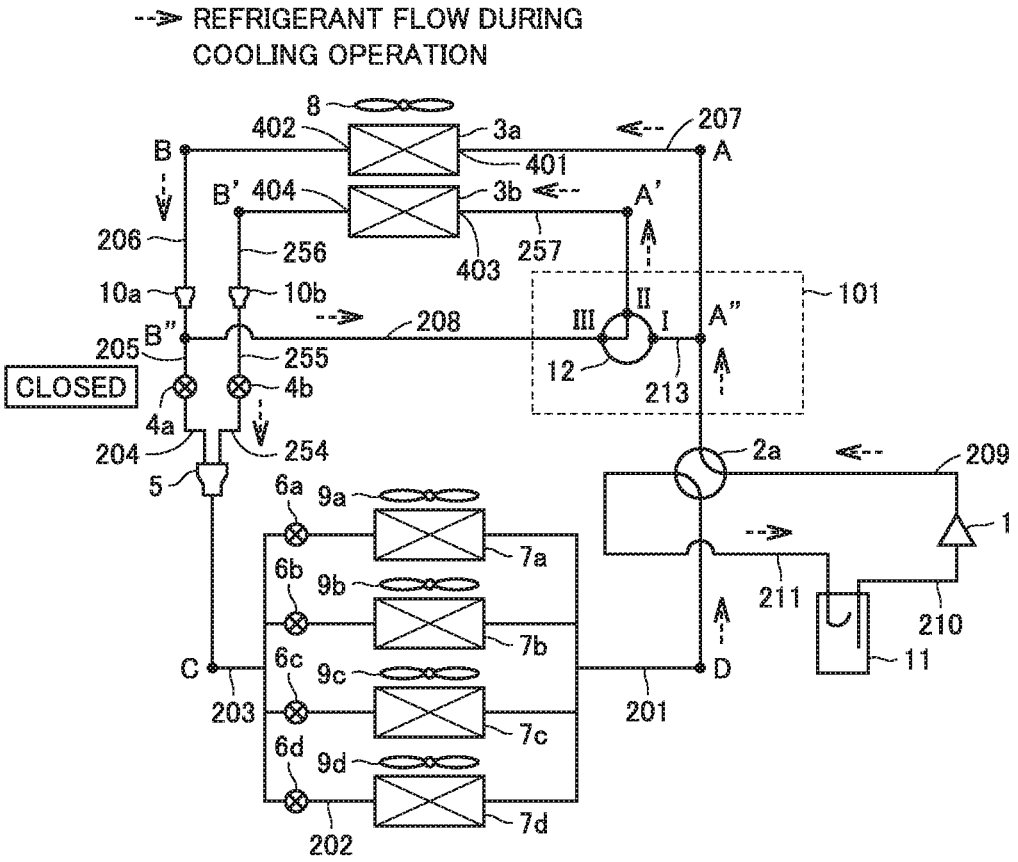
FIG. 2 is a schematic view showing a refrigerant flow during a cooling operation in the refrigeration cycle apparatus in accordance with the first embodiment of the present invention.

FIG. 1 is a schematic view showing a refrigerant flow when a refrigeration cycle apparatus in the present embodiment is operated under conditions for a heating operation. Further, FIG. 2 is a schematic view showing a refrigerant flow when the refrigeration cycle apparatus in FIG. 1 is operated under conditions for a cooling operation. A configuration of the refrigeration cycle apparatus shown in FIGS. 1 and 2 will be described. In the following, the configuration in the present embodiment will be described using a refrigeration cycle apparatus including a plurality of indoor units for one outdoor unit, such as a multi air conditioner for buildings, as an example.

A refrigeration cycle apparatus in accordance with one embodiment of the present invention includes a refrigerant circuit in which refrigerant circulates. The refrigerant circuit includes a compressor 1, indoor heat exchangers 7*a* to 7*d* as a first heat exchanger, indoor fans 9*a* to 9*d* as a first fan, expansion valves 6*a* to 6*d*, a branch portion 5, refrigerant distribution devices 10*a* and 10*b* (hereinafter also referred to as distribution devices), outdoor heat exchangers 3*a* and 3*b* as a second heat exchanger, an outdoor fan 8 as a second fan, a four-way valve 2*a* connected to compressor 1 and the first heat exchanger (indoor heat exchangers 7*a* to 7*d*), and a flow path switching device 12. The second heat exchanger includes outdoor heat exchanger 3*a* as a first refrigerant flow path, and outdoor heat exchanger 3*b* as a second refrigerant flow path. Outdoor heat exchanger 3*a* and outdoor heat exchanger 3*b* are connected in parallel to indoor heat exchangers 7*a* to 7*d* via branch portion 5. Branch portion 5 is a three-way tube, for example. Outdoor heat exchanger 3*a* (the first refrigerant flow path) includes a first end portion 401, and a second end portion 402 located opposite to first end portion 401. The refrigerant circuit includes a third refrigerant flow path (pipes 207, 209 to 211) connecting first end portion 401 and compressor 1, and a fourth refrigerant flow path (pipes 204 to 206) connecting second end portion 402 and branch portion 5. Outdoor fan 8 blows air to outdoor heat exchangers 3*a* and 3*b*. Indoor fans 9*a* to 9*d* blow air to indoor heat exchangers 7*a* to 7*d*.

Flow path switching device 12 includes a first port I, a second port II, and a third port III. First port I is connected with the third refrigerant flow path (pipe 207). Specifically, first port I is connected with pipe 207 by a pipe 213. Pipe 213 is connected to a connection point A" with pipe 207. Second port II is connected with the second refrigerant flow path (outdoor heat exchanger 3*b*). Specifically, the second refrigerant flow path (outdoor heat exchanger 3*b*) includes a third end portion 403, and a fourth end portion 404 located opposite to the third end portion. Second port II is connected to third end portion 403 of outdoor heat exchanger 3*b* by a pipe 257. Third port III is connected with the fourth refrigerant flow path (pipes 204 to 206). Specifically, third port III is connected with the fourth refrigerant flow path (pipes 204 to 206) by a pipe 208. In flow path switching device 12, second port II is configured to switch between a state in which second port II is connected to first port I and a state in which second port II is connected to third port III.

In the refrigeration cycle apparatus, compressor 1 includes a discharge portion and a suction portion. The discharge portion of compressor 1 is connected to four-way valve 2*a* via pipe 209. Further, the suction portion of compressor 1 is connected with an accumulator 11 via pipe 210. Accumulator 11 is connected to four-way valve 2*a* via pipe 211. Further, four-way valve 2*a* is connected in parallel to indoor heat exchangers 7*a* to 7*d* with respect to each other via a pipe 201.

Indoor heat exchangers 7*a* to 7*d* are connected with expansion valves 6*a* to 6*d*, respectively, via pipes 202. Expansion valves 6*a* to 6*d* are connected to branch portion 5, which is a three-way tube, via a pipe 203. Branch portion 5 is connected with expansion valves 4*a* and 4*b* via pipes 204 and 254. Expansion valve 4*a* is connected with refrigerant distribution device 10*a* via pipe 205. A connection point B" with pipe 208 is formed on pipe 205. From a different viewpoint, the refrigeration cycle apparatus further includes an on-off valve (expansion valve 4*a*) arranged between connection point B" and branch portion 5 in the fourth refrigerant flow path (pipes 204 to 206). Refrigerant distribution device 10*a* is connected with second end portion 402 of outdoor heat exchanger 3*a* via pipe 206. Expansion valve 4*b* is connected with refrigerant distribution device 10*b* via a pipe 255. Refrigerant distribution device 10*b* is connected with fourth end portion 404 of outdoor heat exchanger 3*b* via a pipe 256. It should be noted that expansion valves 4*a* and 4*b* may not be arranged in the configuration described above.

First end portion 401 of outdoor heat exchanger 3*a* is connected to four-way valve 2*a* via pipe 207. First port I of flow path switching device 12 is connected to pipe 207 via pipe 213 at connection point A", which is some point in pipe 207.

As described later, the refrigeration cycle apparatus is operable in a first operation state (a heating operation state) in which the on-off valve (expansion valve 4*a*) and expansion valve 4*b* are set in an opened state and second port II is connected to first port I in flow path switching device 12. Further, the refrigeration cycle apparatus is operable in a second operation state (a cooling operation state) in which the on-off valve (expansion valve 4*a*) is set in a closed state, expansion valve 4*b* is set in an opened state, and second port II is connected to third port III in flow path switching device 12.

<Operation and Function/Effect of Refrigeration Cycle Apparatus>

(1) During Heating Operation

In the following, an operation state of the refrigeration cycle apparatus shown in FIG. 1 will be described along the refrigerant flow during the heating operation shown in FIG. 1. As shown in FIG. 1, high-temperature and high-pressure gas refrigerant compressed by compressor 1 passes through four-way valve 2*a* and reaches a point D in pipe 201. After passing through point D in pipe 201, the gas refrigerant is branched, and branched refrigerants pass through a plurality of indoor heat exchangers 7*a* to 7*d*, respectively. On this occasion, indoor heat exchangers 7*a* to 7*d* function as condensers, and the refrigerants within indoor heat exchangers 7*a* to 7*d* are cooled and liquefied by the air blown by indoor fans 9*a* to 9*d*.

The liquefied liquid refrigerants pass through expansion valves 6*a* to 6*d*, respectively, to have a two-phase refrigerant state in which low-temperature and low-pressure gas refrigerant and liquid refrigerant are mixed, and the two-phase refrigerants reach a point C in pipe 203. Then, the refrigerant passes through branch portion 5, which is a three-way pipe. The refrigerant (two-phase refrigerant) is branched into two by branch portion 5, and branched refrigerants flow into refrigerant distribution devices 10*a* and 10*b* through expansion valves 4*a* and 4*b*, respectively. Then, the refrigerants having passed through refrigerant distribution devices 10*a* and 10*b* reach a point B in pipe 206 and a point B' in pipe 256, respectively. On this occasion, pipe 208 is connected to point B" located between expansion valve 4*a* and refrigerant distribution device 10*a*. Pipe 208 serves as a flow path connected from pipe 205 to third port III of flow path switching device 12 constituting a refrigerant flow path switching circuit 101, to bypass outdoor heat exchanger 3*a*. However, since a flow path connected to third port III is not formed in flow path switching device 12 as shown in FIG. 1, no refrigerant flow occurs in pipe 208.

The refrigerants (two-phase refrigerants) having passed through point B in pipe 206 and point B' in pipe 256 flow into outdoor heat exchangers 3*a* and 3*b*, respectively, in parallel. Outdoor heat exchangers 3*a* and 3*b* function as evaporators. Thus, the refrigerants are heated by the air supplied to outdoor heat exchangers 3*a* and 3*b* by outdoor fan 8, and reach a point A in pipe 207 and a point A' in pipe 257 in a gasified state (as gas refrigerants). The gas refrigerant having passed through point A' flows into second port II of flow path switching device 12 of refrigerant flow path switching circuit 101.

Here, since a flow path connected from second port II to first port I is formed in flow path switching device 12, the gas refrigerant having flowed from point A' into second port II flows to first port I. On the other hand, since first port I of flow path switching device 12 of refrigerant flow path switching circuit 101 is connected with pipe 207, the gas refrigerant having passed through point A in pipe 207 joins the gas refrigerant supplied from pipe 257 to second port II of flow path switching device 12, at a connection portion where first port I is connected with pipe 207. Then, the joined gas refrigerant returns to compressor 1 through four-way valve 2*a* and accumulator 11. By this cycle, the heating operation for heating indoor air is performed.

(2) During Cooling Operation

Next, an operation state of the refrigeration cycle apparatus during the cooling operation will be described along the refrigerant flow during the cooling operation shown in FIG. 2. As shown in FIG. 2, high-temperature and high-pressure gas refrigerant compressed by compressor 1 passes through four-way valve 2*a* via pipe 209, and reaches the connection portion where first port I of flow path switching device 12 is connected to pipe 207. Here, in flow path switching device 12 constituting refrigerant flow path switching circuit 101, a flow path connected from first port I to second port II or third port III is not formed, as shown in FIG. 2. Thus, a refrigerant flow flowing into flow path switching device 12 from first port I does not occur. Therefore, the entire refrigerant in a high-temperature and high-pressure gas state (gas refrigerant) supplied from four-way valve 2*a* to pipe 207 passes through point A" and proceeds to point A.

The gas refrigerant having passed through point A flows into outdoor heat exchanger 3*a*. Outdoor heat exchanger 3*a* functions as a condenser. Specifically, the gas refrigerant is cooled by the air supplied to outdoor heat exchanger 3*a* by outdoor fan 8, and changes its phase to a two-phase refrigerant state in which gas refrigerant and liquid refrigerant are mixed, or a single-phase state including liquid refrigerant. Then, the refrigerant discharged from second end portion 402 of outdoor heat exchanger 3*a* into pipe 206 reaches point B. The refrigerant (two-phase refrigerant or liquid refrigerant) having passed through point B reaches point B" via refrigerant distribution device 10*a*. Here, expansion valve 4*a* is set in a closed state. Thus, the refrigerant flow is inevitably guided to refrigerant flow path switching circuit 101 via pipe 208. The refrigerant having flowed through pipe 208 reaches third port III of flow path switching device 12.

In flow path switching device 12, a flow path connecting third port III and second port II is formed. Thus, the refrigerant (two-phase refrigerant or liquid refrigerant) having flowed into third port III flows from second port II into pipe 257, and reaches point A'. Then, the refrigerant flows into outdoor heat exchanger 3*b*. The refrigerant is cooled in outdoor heat exchanger 3*b* by the air supplied to outdoor heat exchanger 3*b* by outdoor fan 8, and turns into supercooled single-phase liquid refrigerant. The single-phase liquid refrigerant flows from outdoor heat exchanger 3*b* into pipe 256 and reaches point B'. As described above, the refrigerant flows to pass through outdoor heat exchangers 3*a* and 3*b* in series in the course of flowing from point A to point B'. The single-phase liquid refrigerant having passed through point B' reaches point C in pipe 203 through refrigerant distribution device 10*b*, expansion valve 4*b*, and branch portion 5. The single-phase liquid refrigerant having passed through point C is branched, and branched refrigerants pass through a plurality of expansion valves 6*a* to 6*d*, respectively, to have a two-phase refrigerant state in which low-temperature and low-pressure gas refrigerant and liquid refrigerant are mixed. Then, the refrigerants in the two-phase refrigerant state pass through the plurality of indoor heat exchangers 7*a* to 7*b*, respectively. On this occasion, indoor heat exchangers 7*a* to 7*d* function as evaporators. Specifically, liquid-phase refrigerants in the refrigerants in the two-phase refrigerant state are heated, evaporated, and gasified by the air supplied to indoor heat exchangers 7*a* to 7*d* by indoor fans 9*a* to 9*d*. The gasified refrigerants (gas refrigerants) are discharged from indoor heat exchangers 7*a* to 7*d* and joined, and the joined refrigerant reaches point D in pipe 201. Then, the refrigerant returns to compressor 1 through four-way valve 2*a* and accumulator 11. By this cycle, the cooling operation for removing heat from the indoor air (cooling the indoor air) in indoor heat exchangers 7*a* to 7*d* is performed.

By respectively performing the heating operation and the cooling operation as described above, when outdoor heat exchangers 3*a* and 3*b* function as condensers such as during the cooling operation, the number of branches in the refrigerant flow paths is decreased and the refrigerant is caused to flow through outdoor heat exchangers 3*a* and 3*b* in series, achieving a state in which the refrigerant has a fast flow velocity. Further, when outdoor heat exchangers 3*a* and 3*b* function as evaporators such as during the heating operation, the number of branches in the refrigerant flow paths is increased and the refrigerant is caused to flow through outdoor heat exchangers 3*a* and 3*b* in parallel, achieving a state in which the refrigerant has a slow flow velocity. As a result, heat exchange efficiency in outdoor heat exchangers 3*a* and 3*b* can be improved by adopting the number of branches in the refrigerant flow paths which is effective for the function exhibited by the heat exchangers.

<Exemplary Configuration of Flow Path Switching Device>

Figure 3:
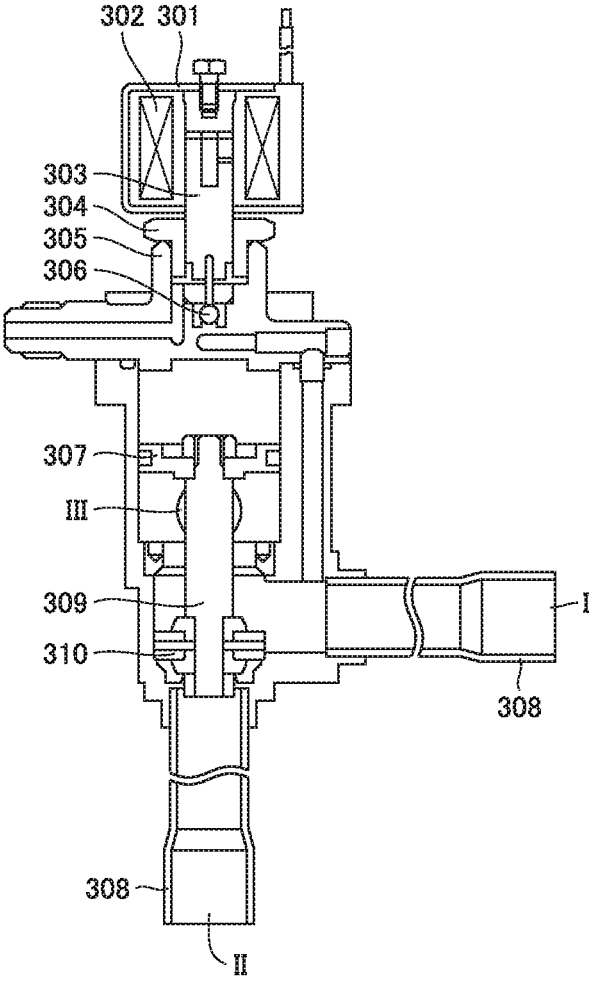
FIG. 3 is a schematic view of a flow path switching device in the refrigeration cycle apparatus in accordance with the first embodiment of the present invention.

Next, flow path switching device 12 constituting refrigerant flow path switching circuit 101 in the present embodiment will be described. Flow path switching device 12 includes a three-way valve, for example. Flow path switching device 12 can be implemented, for example, by using a pilot-type valve as shown in FIG. 3 or the like. A configuration of the flow path switching device shown in FIG. 3 will be described below.

The flow path switching device shown in FIG. 3 is a so-called pilot-type three-way valve, including: a body portion having first port I, second port II, and third port III formed therein: a valve stem 309 arranged inside the body portion and having a valve 310 provided at a tip thereof; a piston 307; an electromagnetic coil 302 arranged above the body portion; an outer case 301 covering an outer circumference of electromagnetic coil 302; a plunger 303 movably arranged on a bottom side of electromagnetic coil 302; an electromagnetic portion top lid 304 and a top lid 305 arranged between the body portion and electromagnetic coil 302; and a valve 306 located on a tip side of plunger 303. First port I and second port II are constituted by joints 308 connected to the body portion.

In flow path switching device 12, when the flow paths have different Cv values depending on the structure of the valve to be used, the Cv value of the flow path connected from second port II to first port I in which a pressure loss significantly contributes to the performance of the refrigeration cycle apparatus may be relatively increased, and the Cv value of the flow path connected from third port III to second port II may be relatively decreased. Different methods for driving flow path switching device 12 can be used for a case where the flow path from third port III to second port II is opened by energizing electromagnetic coil 302 during the cooling operation and a case where the flow path from second port II to first port I is opened by de-energizing electromagnetic coil 302 during the heating operation. Further, conditions for opening the flow path by energizing or de-energizing electromagnetic coil 302 are not limited to the conditions described above, and the flow path from second port II to first port I may be opened upon energization of the coil, and the flow path from third port III to second port II may be opened upon de-energization of the coil. Furthermore, an operation mode of the cooling operation and the heating operation can be controlled when a controller (microcomputer) in a printed board controlling various actuators in the refrigeration cycle apparatus recognizes an operation mode, and transmits a signal for controlling whether to energize flow path switching device 12, which is a three-way valve, for example.

In addition, although the present embodiment has described the pilot-type valve as an example of flow path switching device 12, this is merely a representative example, and another valve such as a rotor-type valve or a direct operated valve may be used as flow path switching device 12.

As described above, in refrigerant flow path switching circuit 101 in the present embodiment, efficient heating operation and cooling operation can be performed at low cost and in a space-saving manner, using flow path switching device 12 constituted by a single device, unlike a conventional case.

Second Embodiment

<Configuration of Refrigeration Cycle Apparatus>

Figure 4:
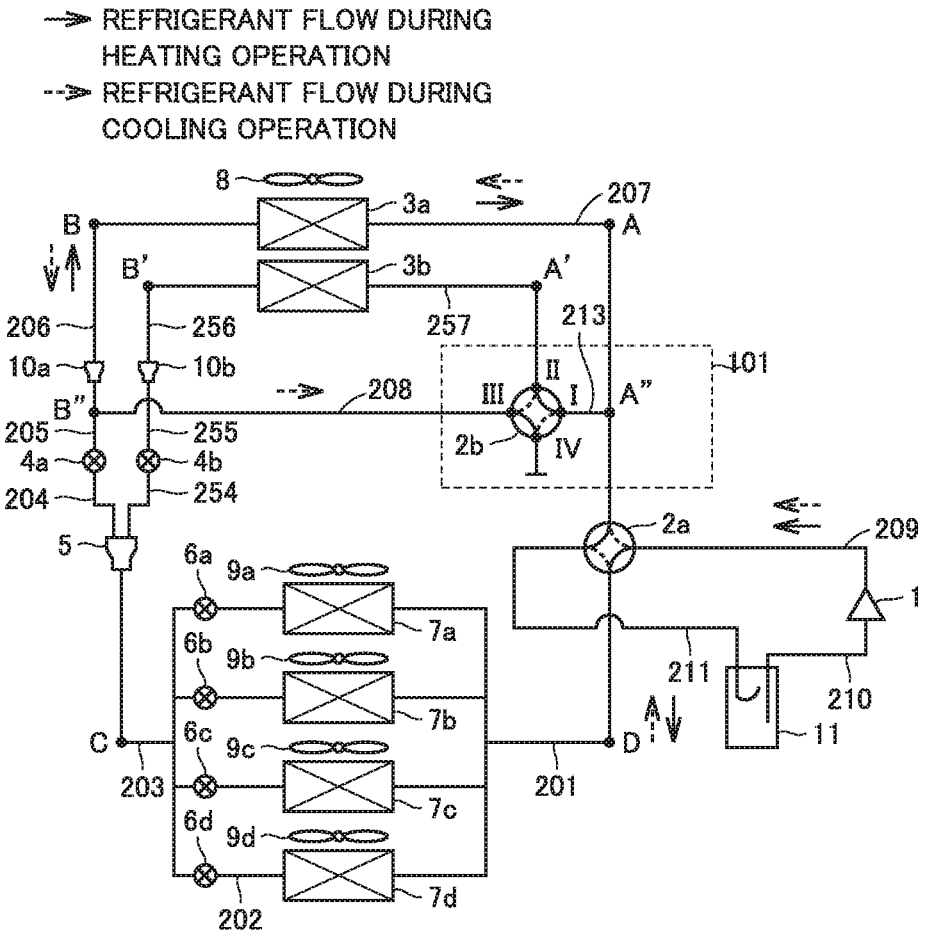
FIG. 4 is a schematic view showing refrigerant flows during a heating operation and during a cooling operation in a refrigeration cycle apparatus in accordance with a second embodiment of the present invention.
Figure 5:
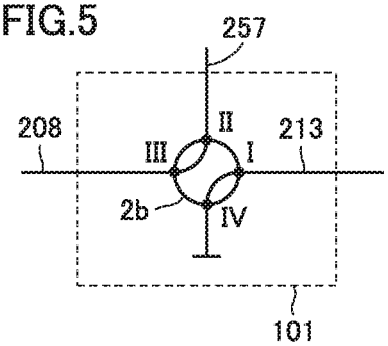
FIG. 5 is a schematic diagram for illustrating a state of a flow path switching device during the cooling operation in the second embodiment of the present invention.
Figure 6:
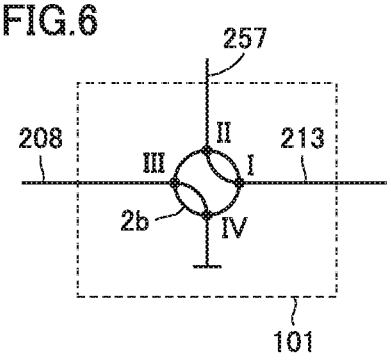
FIG. 6 is a schematic diagram for illustrating a state of the flow path switching device during the heating operation in the second embodiment of the present invention.

FIG. 4 is a schematic view showing refrigerant flows during a heating operation and during a cooling operation in a refrigeration cycle apparatus in accordance with the present embodiment. FIG. 5 is a schematic diagram for illustrating a state of a flow path switching device during the cooling operation in the refrigeration cycle apparatus shown in FIG. 4. FIG. 6 is a schematic diagram for illustrating a state of the flow path switching device during the heating operation in the refrigeration cycle apparatus shown in FIG. 4. Although the refrigeration cycle apparatus in accordance with the present embodiment has basically the same configuration as that of the refrigeration cycle apparatus shown in FIGS. 1 to 3, it is different from the refrigeration cycle apparatus shown in FIGS. 1 to 3 in the configuration of flow path switching device 12. A specific description will be given below.

In the refrigeration cycle apparatus shown in FIGS. 4 to 6, a handled component is simplified regarding flow path switching device 12 constituting refrigerant flow path switching circuit 101. That is, as flow path switching device 12 in refrigeration cycle apparatus shown in FIG. 4, a four-way valve 2*b* which is the same type as four-way valve 2*a* is used. From a different viewpoint, flow path switching device 12 includes four-way valve 2*b*. Four-way valve 2*b* has four ports, that is, first port I to fourth port IV, and regarding fourth port IV, a flow path connected to fourth port IV is closed. As a result, four-way valve 2*b* can exhibit the same function as that of flow path switching device 12 in the first embodiment.

For example, in a state where first port I of four-way valve 2*b* is connected with fourth port IV and second port II is connected with third port III as shown in FIG. 5, refrigerant flows in a direction indicated by dotted-line arrows in FIG. 4, and the cooling operation can be performed. Further, in a state where the first port is connected with second port II and third port III is connected with fourth port IV as shown in FIG. 6, the refrigerant flows in a direction indicated by solid-line arrows in FIG. 4, and the heating operation can be performed.

With such a configuration, efficient heating operation and cooling operation can be performed as with the refrigeration cycle apparatus in the first embodiment. Furthermore, by using the configuration of the present embodiment, there is no need to newly prepare a three-way valve, which is a component of a type different from four-way valve 2*a*, as flow path switching device 12, as in the first embodiment, and flow path switching device 12 can be constituted by the same type of component as four-way valve 2*a*. Thus, the amount of four-way valves used is increased, which leads to a reduction in the unit price of the components. In addition, in a case where a three-way valve is used as flow path switching device 12 as in the first embodiment, it is necessary to perform inventory control and the like for the three-way valve. However, by constituting flow path switching device 12 using four-way valve 2*b* and achieving component commonality as in the present embodiment, the manufacturing cost of the refrigeration cycle apparatus which exhibits the same effect as that in the first embodiment can be reduced as a result.

<Operation and Function/Effect of Refrigeration Cycle Apparatus>

The operation of the refrigeration cycle apparatus in accordance with the present embodiment is basically the same as that of the refrigeration cycle apparatus shown in FIGS. 1 to 3, and the same effect can be obtained.

Third Embodiment

<Configuration of Refrigeration Cycle Apparatus>

Figure 7:
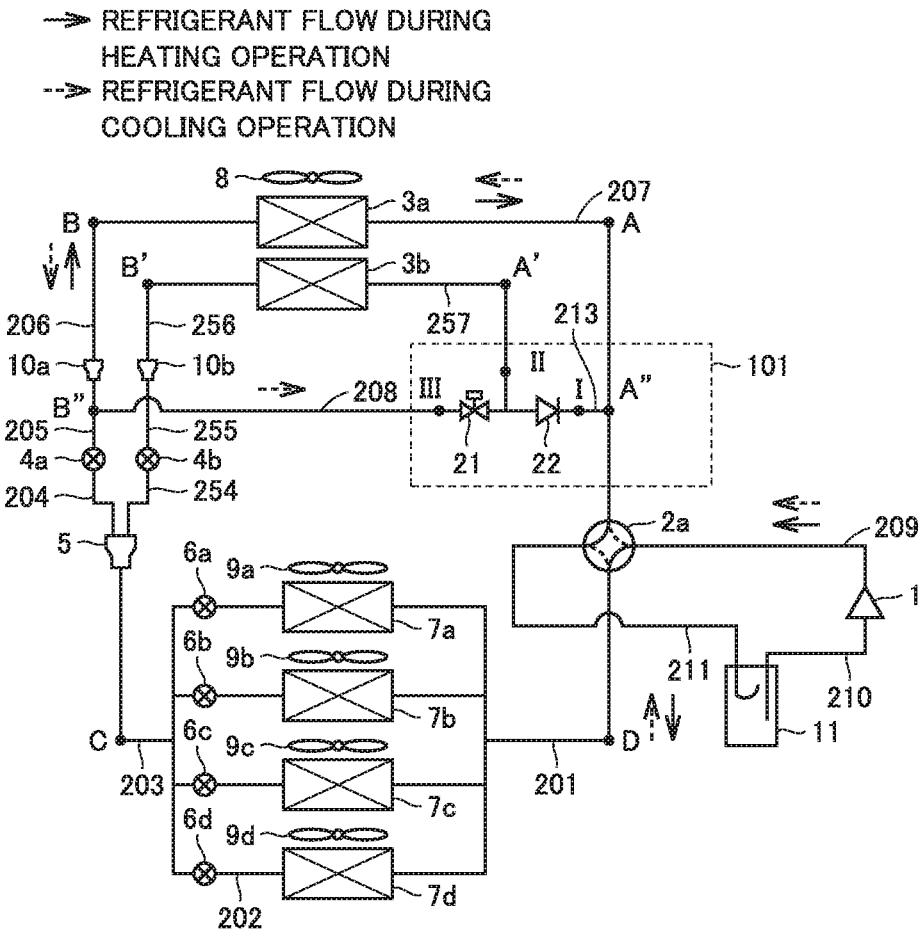
FIG. 7 is a schematic view showing refrigerant flows during a heating operation and during a cooling operation in a refrigeration cycle apparatus in accordance with a third embodiment of the present invention.
Figure 8:
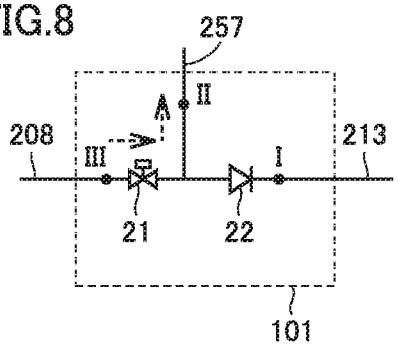
FIG. 8 is a schematic diagram for illustrating a state of a flow path switching device during the cooling operation in the third embodiment of the present invention.
Figure 9:
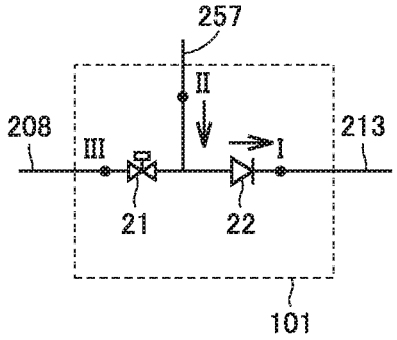
FIG. 9 is a schematic diagram for illustrating a state of the flow path switching device during the heating operation in the third embodiment of the present invention.

FIG. 7 is a schematic view showing refrigerant flows during a heating operation and during a cooling operation in a refrigeration cycle apparatus in accordance with the present embodiment. FIG. 8 is a schematic diagram for illustrating a state of a flow path switching device during the cooling operation in the refrigeration cycle apparatus shown in FIG. 7. FIG. 9 is a schematic diagram for illustrating a state of the flow path switching device during the heating operation in the refrigeration cycle apparatus shown in FIG. 7. Although the refrigeration cycle apparatus in accordance with the present embodiment has basically the same configuration as that of the refrigeration cycle apparatus shown in FIGS. 1 to 3, it is different from the refrigeration cycle apparatus shown in FIGS. 1 to 3 in the configuration of the flow path switching device included in refrigerant flow path switching circuit 101. A specific description will be given below.

In the refrigeration cycle apparatus shown in FIGS. 7 to 9, flow path switching device 12 constituting refrigerant flow path switching circuit 101 is constituted by a solenoid valve 21 and a check valve 22. From a different viewpoint, flow path switching device 12 includes one or more openable and closable valves (solenoid valve 21).

In flow path switching device 12 shown in FIG. 7, one of two ports of solenoid valve 21 corresponds to third port III, and the other of the two ports of solenoid valve 21 is connected to an input side of check valve 22, as shown in FIG. 7. An output side of check valve 22 corresponds to first port I. Further, second port II is arranged to be connected to the other of the two ports of solenoid valve 21 and the input side of check valve 22. Flow path switching device 12 having such a configuration can also exhibit the same function as that of flow path switching device 12 in the first embodiment.

<Operation and Function/Effect of Refrigeration Cycle Apparatus>

The operation of the refrigeration cycle apparatus in accordance with the present embodiment is basically the same as that of the refrigeration cycle apparatus shown in FIGS. 1 to 3, and the same effect can be obtained. For example, during the cooling operation, a flow path is formed from third port III to second port II and refrigerant flows therethrough, as shown in FIG. 8. On the other hand, regarding a flow path from second port II to first port I, the refrigerant at first port I is high-temperature and high-pressure gas refrigerant. Thus, the pressure of the refrigerant on the first port I side is higher than the pressure of the refrigerant on the second port II side, and thereby a refrigerant flow from second port II to first port I is not formed.

Further, a refrigerant flow from first port I to second port II is closed by check valve 22. Thus, the refrigerant flow from first port I to second port II is not formed.

Subsequently, during the heating operation, only the refrigerant flow from second port II to first port I can be formed by closing a flow path of solenoid valve 21 connected to third port III, as shown in FIG. 9. Further, in a partial load operation in which the cooling operation has a small load and the like, only outdoor heat exchanger 3*a* can be used as a refrigerant flow path by closing expansion valve 4*b* and solenoid valve 21.

When both outdoor heat exchangers 3*a* and 3*b* are used in a case where the amount of refrigerant flowing through the refrigerant circuit of the refrigeration cycle apparatus (the amount of circulating refrigerant) is small due to the partial load operation, flow velocity of the refrigerant flowing through outdoor heat exchangers 3*a* and 3*b* may be significantly reduced, and heat transfer rate within flow paths of outdoor heat exchangers 3*a* and 3*b* may be considerably reduced. In this case, heat exchange efficiency in outdoor heat exchangers 3*a* and 3*b* is reduced as a result. In contrast, when only outdoor heat exchanger 3*a* is used as a refrigerant flow path, flow velocity of the refrigerant flowing through outdoor heat exchanger 3*a* is increased when compared with the flow velocity described above, and efficient heat exchange can be performed without reducing heat transfer rate within the flow path of outdoor heat exchanger 3*a*.

It should be noted that the method of using only outdoor heat exchanger 3*a* as a refrigerant flow path is also applicable to the first embodiment and the second embodiment described above. Specifically, the same effect can be obtained by setting flow path switching device 12 in the state during the cooling operation, and then closing expansion valve 4*b*.

In the present embodiment, the manufacturing cost of the refrigeration cycle apparatus can be reduced by adopting a combination of solenoid valve 21 and check valve 22, which are smaller and produced more than the three-way valve in the first embodiment and the four-way valve in the second embodiment, as flow path switching device 12. As a result, the same effect as those in the first embodiment and the second embodiment can be achieved at low cost.

Fourth Embodiment

<Configuration of Refrigeration Cycle Apparatus>

Figure 10:
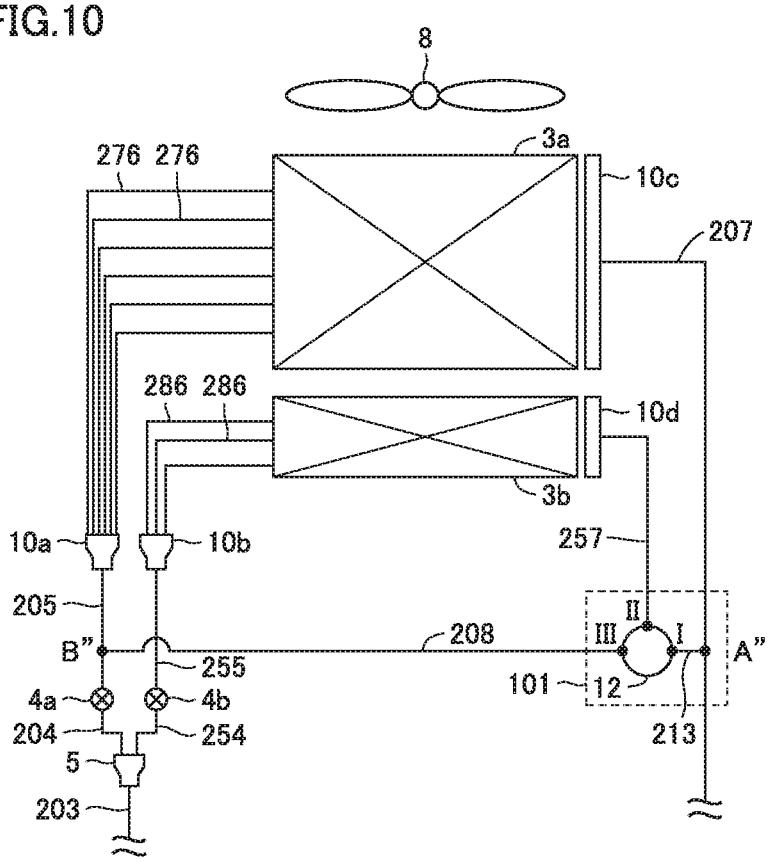
FIG. 10 is a schematic view showing a refrigeration cycle apparatus in accordance with a fourth embodiment of the present invention.
Figure 11:
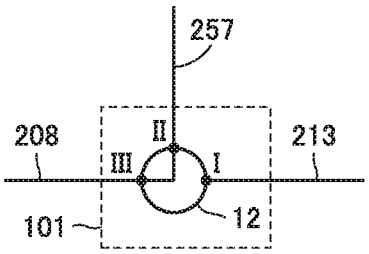
FIG. 11 is a schematic diagram for illustrating a state of a flow path switching device during a cooling operation in the fourth embodiment of the present invention.
Figure 12:
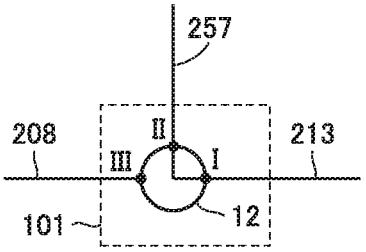
FIG. 12 is a schematic diagram for illustrating a state of the flow path switching device during a heating operation in the fourth embodiment of the present invention.

FIG. 10 is a schematic view showing a refrigeration cycle apparatus in accordance with the present embodiment. FIG. 11 is a schematic diagram for illustrating a state of a flow path switching device during a cooling operation in the refrigeration cycle apparatus shown in FIG. 10. FIG. 12 is a schematic diagram for illustrating a state of the flow path switching device during a heating operation in the refrigeration cycle apparatus shown in FIG. 10. Although the refrigeration cycle apparatus in accordance with the present embodiment has basically the same configuration as that of the refrigeration cycle apparatus shown in FIGS. 1 to 3, it is different from the refrigeration cycle apparatus shown in FIGS. 1 to 3 in the configuration of connection portions between outdoor heat exchangers 3*a*, 3*b* and pipes. A specific description will be given below.

In the refrigeration cycle apparatus shown in FIGS. 10 to 12, a detailed exemplary configuration is shown regarding distribution devices 10*a* to 10*d* used in the first to third embodiments described above. Here, outdoor heat exchanger 3*a* has six flow paths and outdoor heat exchanger 3*b* has three flow paths. However, the numbers of flow paths in outdoor heat exchangers 3*a* and 3*b* are not limited to those in an example of flow path distribution shown in FIG. 10, and may be any numbers.

In the present embodiment, in order to efficiently perform the heating operation as shown in FIG. 12 using outdoor heat exchangers 3*a* and 3*b* as evaporators, distributors are used for distribution devices 10*a* and 10*b* serving as refrigerant inlet sides. It should be noted that, as the configuration of the distributors, a conventionally known configuration can be adopted.

Further, from a different viewpoint, in the refrigeration cycle apparatus shown in FIG. 10, the second refrigerant flow path (outdoor heat exchanger 3*b*) includes a third end portion (an end portion connected with distribution device 10*d* in outdoor heat exchanger 3*b*), and a fourth end portion (an end portion connected with pipes 286 in outdoor heat exchanger 3*b*) located opposite to the third end portion. The refrigerant circuit includes a fifth refrigerant flow path (pipe 257) connecting the third end portion and second port II, and a sixth refrigerant flow path (pipes 286, 255, and 254) connecting the fourth end portion and branch portion 5. At least one of the first refrigerant flow path (outdoor heat exchanger 3*a*) and the second refrigerant flow path (outdoor heat exchanger 3*b*) includes a plurality of flow paths parallel to each other. The refrigerant circuit includes a distributor (distribution devices 10*a* and 10*b*) and a hollow header (distribution devices 10*c* and 10*d*). The distributor (distribution devices 10*a* and 10*b*) connects the plurality of flow paths in the one of the first refrigerant flow path (outdoor heat exchanger 3*a*) and the second refrigerant flow path (outdoor heat exchanger 3*b*), with the fourth refrigerant flow path (pipes 276) or the sixth refrigerant flow path (pipes 286). The hollow header (distribution devices 10*c* and 10*d*) connects the plurality of flow paths in the one of the first refrigerant flow path (outdoor heat exchanger 3*a*) and the second refrigerant flow path) outdoor heat exchanger 3*b*), with the third refrigerant flow path (pipe 207) or the fifth refrigerant flow path (pipe 257).

It is generally known that a distributor uniformly distributes two-phase refrigerant including liquid refrigerant and gas refrigerant by disturbing the flow of the refrigerant and diffusing the refrigerant in a flow contraction portion therein. On the other hand, there is a problem that the turbulent flow of the refrigerant caused by the flow contraction portion increases a pressure loss inside the distributor. However, a refrigeration cycle serving as the heating operation can be established by activating the refrigeration cycle apparatus by setting a total sum of pressure losses in distribution devices 10*a* and 10*b* serving as distributors and decompression amounts in expansion valves 4*a* and 4*b* located upstream of distribution devices 10*a* and 10*b*, as a desired total decompression amount.

Next, distribution devices 10*c* and 10*d* serving as refrigerant outlet sides for outdoor heat exchangers 3*a* and 3*b* during the heating operation will be described. As distribution devices 10*c* and 10*d*, hollow headers having a hollow interior are used, for example. This is because, since gasified refrigerant having flowed out of outdoor heat exchanger 3*a*, 3*b* passes through distribution device 10*c*, 10*d* with a low pressure loss, the refrigerant having a higher suction pressure can efficiently activate compressor 1 when the refrigerant is sucked into compressor 1 located downstream of outdoor heat exchanger 3*a*, 3*b*. Such efficient activation of compressor 1 can lead to energy saving of the refrigeration cycle as a result.

Further, when high-temperature and high-pressure gas refrigerant flows into distribution device 10*c* in the cooling operation as shown in FIG. 11 using outdoor heat exchangers 3*a* and 3*b* as condensers, the refrigerant can be uniformly divided with a low pressure loss in distribution device 10*c*, in the refrigeration cycle apparatus in accordance with the present embodiment. On the other hand, single-phase liquid refrigerant liquefied by outdoor heat exchanger 3*a*, or two-phase refrigerant including liquid refrigerant and gas refrigerant mixed therein flows into distribution device 10*d*. Thus, it is preferable to cause refrigerant which has been subjected to heat exchange in outdoor heat exchanger 3*a* and has turned into single-phase liquid refrigerant to flow into distribution device 10*d*, and utilize outdoor heat exchanger 3*b* to supercool the refrigerant. This is because, since the single-phase liquid refrigerant does not have a large density difference depending on the temperature, the refrigerant can be relatively uniformly divided within distribution device 10*d*.

The reason for adopting different components for distribution devices 10*a*, 10*b* and distribution devices 10*c*, 10*d* as shown in FIG. 10 is that, if hollow headers are used for distribution devices 10*a* and 10*b* through which the refrigerant including gas refrigerant and liquid refrigerant mixed therein (two-phase refrigerant) flows, the gas refrigerant and the liquid refrigerant having significantly different densities may be ununiformly distributed due to the influence of gravity, and heat exchange performance may be significantly deteriorated as a result. Accordingly, distributors are used for distribution devices 10*a* and 10*b*, and hollow headers are used for distribution devices 10*c* and 10*d*. Such a configuration is a usage example of the distribution devices allowing the heating operation to be efficiently performed.

<Operation and Function/Effect of Refrigeration Cycle Apparatus>

The operation of the refrigeration cycle apparatus in accordance with the present embodiment is basically the same as that of the refrigeration cycle apparatus shown in FIGS. 1 to 3, and the same effect can be obtained.

Figure 13:
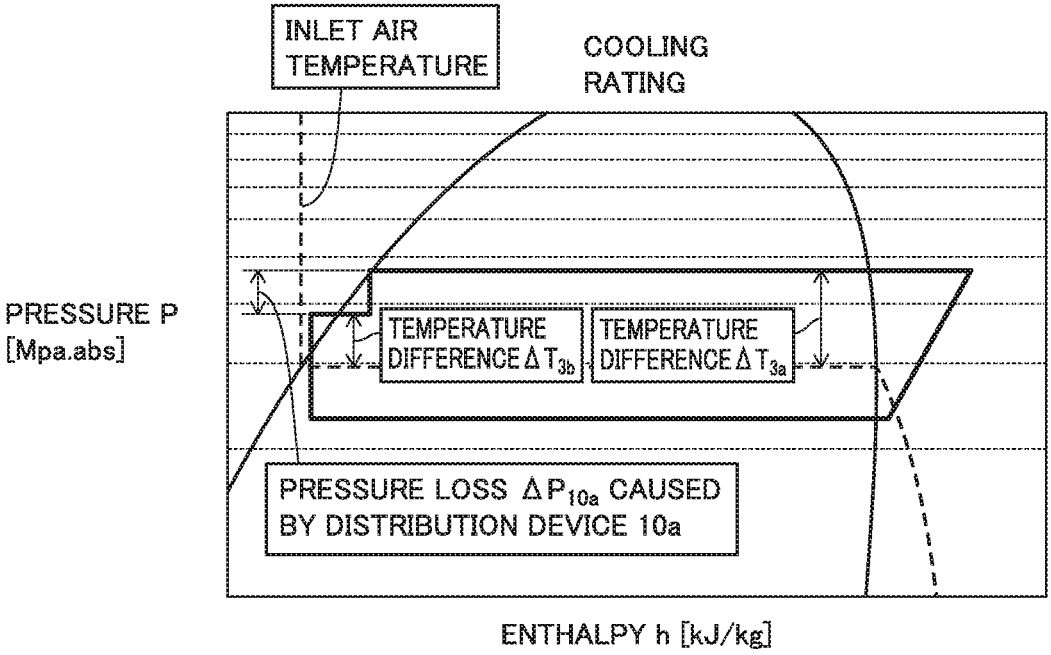
FIG. 13 is a Mollier chart in the refrigeration cycle apparatus.

In addition, the operating state of the refrigerant passing through outdoor heat exchangers 3*a* and 3*b* when the present embodiment is used for the cooling operation will be described using a Mollier chart in FIG. 13. FIG. 13 is a Mollier chart having the axis of abscissas representing enthalpy h (unit: kJ/kg) and the axis of ordinates representing pressure P (unit: MPa). When outdoor heat exchangers 3*a* and 3*b* are used as condensers in the cooling operation, distribution device 10*c* uniformly distributes the gas refrigerant to the plurality of flow paths in outdoor heat exchanger 3*a*. Then, based on a temperature difference $\Delta T_{3a}$ from air temperature, the gas refrigerant exchanges heat with the air and is liquefied to turn into single-phase liquid. The liquefied refrigerant (liquid refrigerant) passes through distribution device 10*a*. On this occasion, in distribution device 10*a*, a pressure loss $\Delta P_{10a}$ is caused by the distributor. Thus, the two-phase refrigerant including liquid refrigerant and gas refrigerant having flowed into outdoor heat exchanger 3*b* through distribution device 10*a* exchanges heat based on a temperature difference $\Delta T_{3b}$ from the air temperature. Here, it is difficult for outdoor heat exchanger 3*b* to secure the temperature difference from the temperature of the air with which the refrigerant exchanges heat, when compared with outdoor heat exchanger 3*a*, because temperature difference $\Delta T_{3a}$>temperature difference $\Delta T_{3b}$. That is, the present embodiment is characterized by adopting a distribution device configuration for efficiently activating the heating operation.

Fifth Embodiment

<Configuration of Refrigeration Cycle Apparatus>

Figure 14:
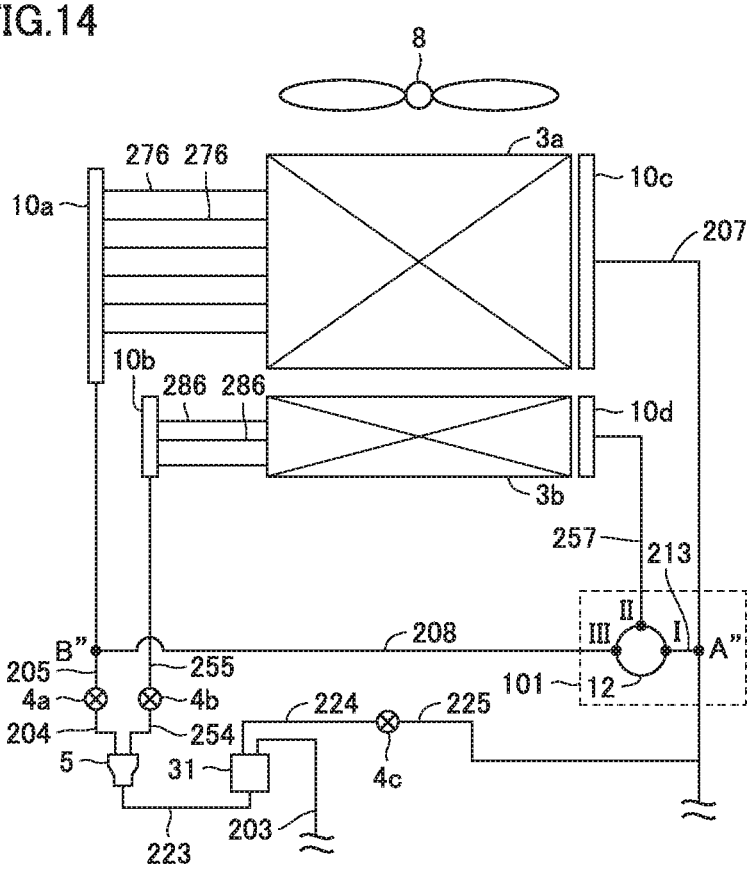
FIG. 14 is a schematic view showing a refrigeration cycle apparatus in accordance with a fifth embodiment of the present invention.
Figure 15:
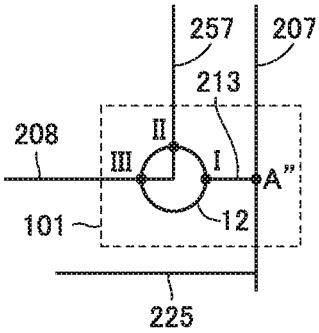
FIG. 15 is a schematic diagram for illustrating a state of a flow path switching device during a cooling operation in the fifth embodiment of the present invention.
Figure 16:
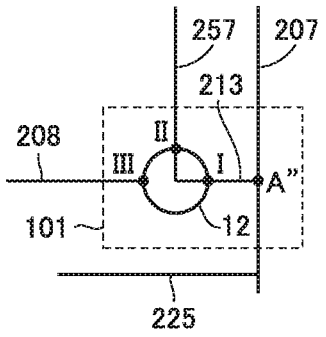
FIG. 16 is a schematic diagram for illustrating a state of the flow path switching device during a heating operation in the fifth embodiment of the present invention.

FIG. 14 is a schematic view showing a refrigeration cycle apparatus in accordance with the present embodiment. FIG. 15 is a schematic diagram for illustrating a state of a flow path switching device during a cooling operation in the refrigeration cycle apparatus shown in FIG. 14. FIG. 16 is a schematic diagram for illustrating a state of the flow path switching device during a heating operation in the refrigeration cycle apparatus shown in FIG. 14. Although the refrigeration cycle apparatus in accordance with the present embodiment has basically the same configuration as that of the refrigeration cycle apparatus shown in FIGS. 1 to 3, it is different from the refrigeration cycle apparatus shown in FIGS. 1 to 3 in the configuration of connection portions between outdoor heat exchangers 3*a*, 3*b* and pipes, and in that it includes a gas-liquid separator 31. A specific description will be given below.

The refrigeration cycle apparatus shown in FIGS. 14 to 16 is configured such that distribution devices 10*a* to 10*d* used in the fourth embodiment can be effectively utilized in both the heating operation and the cooling operation. As described for the refrigeration cycle apparatus in accordance with the fourth embodiment, distribution device 10*a* is required to have a function of uniformly distributing refrigerant during the heating operation in which flow path switching device 12 is controlled as shown in FIG. 16, and a function of joining refrigerants with a low pressure loss and securing large temperature difference $\Delta T_3$b in outdoor heat exchanger 3*b* during the cooling operation shown in FIG. 15. Thus, in the present embodiment, hollow headers are used for distribution devices 10*a* and 10*b*. Furthermore, a form including gas-liquid separator 31 at upstream of distribution device 10*a* in the heating operation is used.

Specifically, distribution device 10*a* which is a hollow head is connected to a plurality of flow paths in outdoor heat exchanger 3*a* by a plurality of pipes 276. Further, distribution device 10*b* which is a hollow head is also connected to a plurality of flow paths in outdoor heat exchanger 3*b* by a plurality of pipes 286.

In addition, gas-liquid separator 31 is arranged at some point in pipes 203 and 223 which connect branch portion 5 and expansion valves 6*a* to 6*d* (see FIG. 1). Specifically, expansion valves 6*a* to 6*d* are connected to gas-liquid separator 31 by pipe 203. Gas-liquid separator 31 is connected with branch portion 5 by pipe 223. Gas-liquid separator 31 is connected with an expansion valve 4*c* by a pipe 224. Expansion valve 4*c* is connected with pipe 207 by a pipe 225. Pipe 225 is connected to a portion located between four-way valve 2*a* and a portion connected with first port I in pipe 207.

From a different viewpoint, in the refrigeration cycle apparatus shown in FIG. 14, the second refrigerant flow path (outdoor heat exchanger 3*b*) includes a third end portion (an end portion connected with distribution device 10*d* in outdoor heat exchanger 3*b*), and a fourth end portion (an end portion connected with pipes 286 in outdoor heat exchanger 3*b*) located opposite to the third end portion. The refrigerant circuit includes a fifth refrigerant flow path (pipe 257) connecting the third end portion and second port II, and a sixth refrigerant flow path (pipes 255 and 254) connecting the fourth end portion and branch portion 5. One of the first refrigerant flow path (outdoor heat exchanger 3*a*) and the second refrigerant flow path (outdoor heat exchanger 3*b*) includes a plurality of flow paths parallel to each other. The refrigerant circuit includes a first hollow header (distribution device 10*a*) and a second hollow header (distribution device 10*c*). The first hollow header (distribution device 10*a*) connects the plurality of flow paths in the one of the first refrigerant flow path (outdoor heat exchanger 3*a*) and the second refrigerant flow path (outdoor heat exchanger 3*b*), with the fourth refrigerant flow path (pipes 204 and 205) or the sixth refrigerant flow path (pipes 254 and 255). The second hollow header (distribution device 10*c*) connects the plurality of flow paths in the one of the first refrigerant flow path (outdoor heat exchanger 3*a*) and the second refrigerant flow path (outdoor heat exchanger 3*b*), with the third refrigerant flow path (pipe 207) or the fifth refrigerant flow path (pipe 257). Further, the refrigerant circuit includes gas-liquid separator 31 and a seventh refrigerant flow path (pipes 224 and 225). Gas-liquid separator 31 is connected with the first heat exchanger (indoor heat exchangers 7*a* to 7*d*) and branch portion 5. The seventh refrigerant flow path (pipes 224 and 225) connects gas-liquid separator 31 and the third refrigerant flow path (pipe 207).

<Operation and Function/Effect of Refrigeration Cycle Apparatus>

The operation of the refrigeration cycle apparatus in accordance with the present embodiment is basically the same as that of the refrigeration cycle apparatus shown in FIGS. 1 to 3, and the same effect can be obtained.

In addition, when a hollow header is used as distribution device 10*a* as shown in FIG. 14, the resistance within distribution device 10*a* is small, and it is possible to suppress pressure loss $\Delta P_{10a}$ during the cooling operation as much as possible. On the other hand, during the heating operation, gas-liquid separator 31 is utilized to uniformly distribute two-phase refrigerant to outdoor heat exchanger 3*a*. The two-phase refrigerant including liquid refrigerant and gas refrigerant decompressed by expansion valves 6*a* to 6*d* flows from indoor heat exchangers 7*a* to 7*d* into gas-liquid separator 31. Then, the gas refrigerant flows from gas-liquid separator 31 via pipe 224, expansion valve 4*c*, and pipe 225, while being adjusted by expansion valve 4*c* such that the liquid refrigerant is not mixed therein, and thereby bypasses outdoor heat exchangers 3*a* and 3*b*. On the other hand, single-phase liquid refrigerant or two-phase refrigerant infinitely close to single-phase liquid refrigerant passes through expansion valves 4*a* and 4*b* and flows into outdoor heat exchangers 3*a* and 3*b*. On this occasion, since distribution devices 10*a* and 10*b* each distribute the single-phase liquid refrigerant or the two-phase refrigerant infinitely close to the single-phase liquid refrigerant, distribution devices 10*a* and 10*b* can each distribute the refrigerant in a state substantially close to a desired uniform distribution. This can suppress deterioration of heat-exchange conditions for the refrigerant in outdoor heat exchangers 3*a* and 3*b*. As a result, even when hollow headers are used for distribution devices 10*a* and 10*b*, efficient heat exchange in outdoor heat exchangers 3*a* and 3*b* can be achieved in the heating operation.

Sixth Embodiment

<Configuration of Refrigeration Cycle Apparatus>

Figure 17:
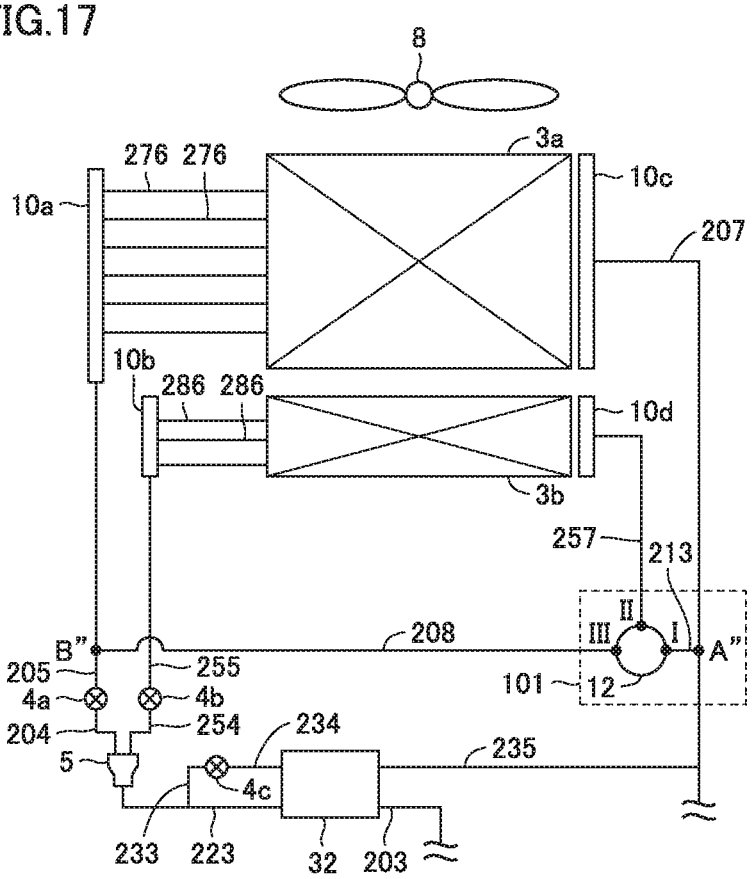
FIG. 17 is a schematic view showing a refrigeration cycle apparatus in accordance with a sixth embodiment of the present invention.
Figure 18:
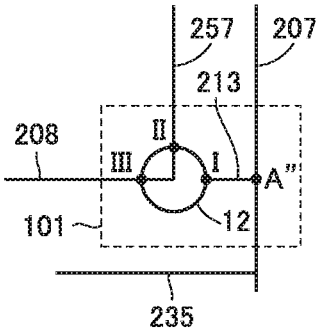
FIG. 18 is a schematic diagram for illustrating a state of a flow path switching device during a cooling operation in the sixth embodiment of the present invention.
Figure 19:
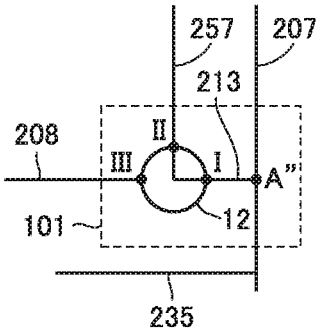
FIG. 19 is a schematic diagram for illustrating a state of the flow path switching device during a heating operation in the sixth embodiment of the present invention.

FIG. 17 is a schematic view showing a refrigeration cycle apparatus in accordance with the present embodiment. FIG. 18 is a schematic diagram for illustrating a state of a flow path switching device during a cooling operation in the refrigeration cycle apparatus shown in FIG. 17. FIG. 19 is a schematic diagram for illustrating a state of the flow path switching device during a heating operation in the refrigeration cycle apparatus shown in FIG. 17. Although the refrigeration cycle apparatus in accordance with the present embodiment has basically the same configuration as that of the refrigeration cycle apparatus shown in FIGS. 1 to 3, it is different from the refrigeration cycle apparatus shown in FIGS. 1 to 3 in the configuration of connection portions between outdoor heat exchangers 3*a*, 3*b* and pipes, and in that it includes a liquid-liquid heat exchanger 32. A specific description will be given below.

As in the fifth embodiment, the refrigeration cycle apparatus shown in FIGS. 17 to 19 is also configured such that distribution devices 10*a* to 10*d* used in the fourth embodiment can be effectively utilized in both the heating operation and the cooling operation. The configuration of distribution devices 10*a* to 10*d* of the refrigeration cycle apparatus shown in FIG. 17 is the same as the configuration of distribution devices 10*a* to 10*d* of the refrigeration cycle apparatus in accordance with the fifth embodiment described above. Furthermore, a form including liquid-liquid heat exchanger 32 at upstream of distribution device 10*a* in the heating operation is used.

Liquid-liquid heat exchanger 32 is arranged at some point in pipes 203 and 223 which connect branch portion 5 and expansion valves 6*a* to 6*d* (see FIG. 1). Specifically, expansion valves 6*a* to 6*d* are connected to liquid-liquid heat exchanger 32 by pipe 203. Liquid-liquid heat exchanger 32 is connected with branch portion 5 by pipe 223. Expansion valve 4*c* is connected to some point in pipe 223 via a pipe 233. Expansion valve 4*c* is connected to liquid-liquid heat exchanger 32 via a pipe 234. Liquid-liquid heat exchanger 32 is connected to pipe 207 via a pipe 235. Refrigerant having flowed into liquid-liquid heat exchanger 32 via pipe 234 flows into pipe 207 via pipe 235. Pipe 235 is connected to a portion located between four-way valve 2*a* and a portion connected with first port I in pipe 207.

From a different viewpoint, in the refrigeration cycle apparatus shown in FIG. 17, the refrigerant circuit includes liquid-liquid heat exchanger 32, an eighth refrigerant flow path (pipe 223), a ninth refrigerant flow path (pipes 233 and 234), and a tenth refrigerant flow path. Liquid-liquid heat exchanger 32 is connected with branch portion 5 via the eighth refrigerant flow path (pipe 223), and is connected with the first heat exchanger (indoor heat exchangers 7*a* to 7*d*). The ninth refrigerant flow path (pipes 233 and 234) connects the eighth refrigerant flow path (pipe 223) and liquid-liquid heat exchanger 32. The tenth refrigerant flow path (pipe 235) connects liquid-liquid heat exchanger 32 and the third refrigerant flow path (pipe 207), to pass the refrigerant having flowed into liquid-liquid heat exchanger 32 via the ninth refrigerant flow path (pipes 233 and 234) to the third refrigerant flow path (pipe 207).

<Operation and Function/Effect of Refrigeration Cycle Apparatus>

The operation of the refrigeration cycle apparatus in accordance with the present embodiment is basically the same as that of the refrigeration cycle apparatus shown in FIGS. 1 to 3, and the same effect can be obtained. In addition, in the refrigeration cycle apparatus shown in FIG. 17, by using liquid-liquid heat exchanger 32, refrigerant flowing into distribution devices 10*a* and 10*b* during the heating operation as shown in FIG. 19 can turn into single-phase liquid refrigerant or two-phase refrigerant infinitely close to single-phase liquid refrigerant. That is, refrigerant whose temperature is reduced by passing through expansion valve 4*c* exchanges heat with refrigerant having flowed from pipe 203 (i.e., cools the refrigerant having flowed from pipe 203) in liquid-liquid heat exchanger 32, and thereby the refrigerant flowing into branch portion 5 and distribution devices 10*a* and 10*b* can turn into the single-phase liquid refrigerant or the two-phase refrigerant infinitely close to the single-phase liquid refrigerant. Accordingly, the same effect as that in the fifth embodiment described above can be obtained. That is, distribution device 10*a* can exhibit a function of uniformly distributing the refrigerant during the heating operation in which flow path switching device 12 is controlled as shown in FIG. 19, and a function of joining refrigerants with a low pressure loss and securing large temperature difference $\Delta T_{3b}$ in outdoor heat exchanger 3*b* during the cooling operation shown in FIG. 18.

Seventh Embodiment

<Configuration of Refrigeration Cycle Apparatus>

Figure 20:
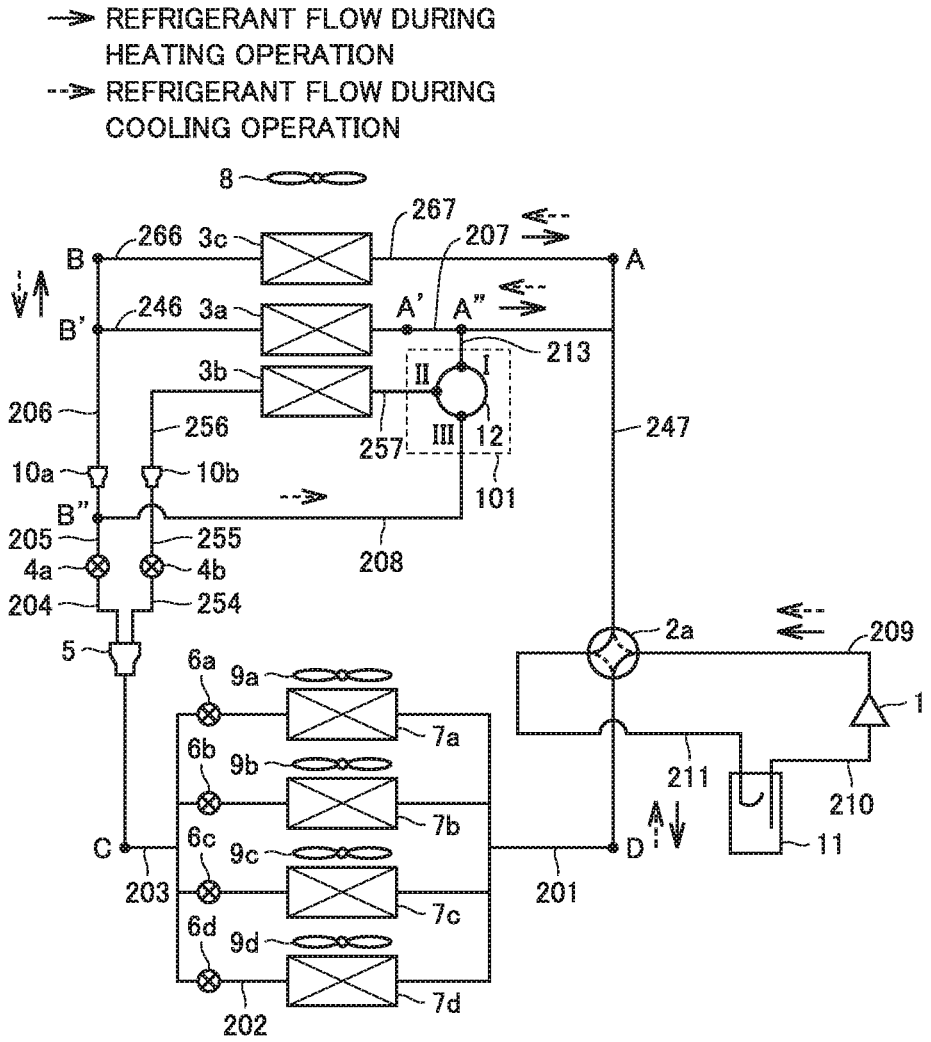
FIG. 20 is a schematic view showing refrigerant flows during a heating operation and during a cooling operation in a refrigeration cycle apparatus in accordance with a seventh embodiment of the present invention.
Figure 21:
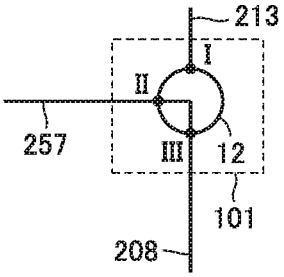
FIG. 21 is a schematic diagram for illustrating a state of a flow path switching device during the cooling operation in the seventh embodiment of the present invention.
Figure 22:
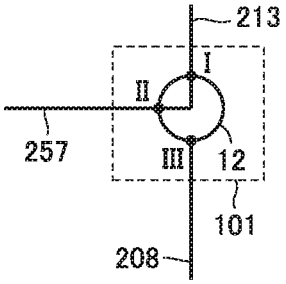
FIG. 22 is a schematic diagram for illustrating a state of the flow path switching device during the heating operation in the seventh embodiment of the present invention.

FIG. 20 is a schematic view showing a refrigeration cycle apparatus in accordance with the present embodiment. FIG. 21 is a schematic diagram for illustrating a state of a flow path switching device during a cooling operation in the refrigeration cycle apparatus shown in FIG. 20. FIG. 22 is a schematic diagram for illustrating a state of the flow path switching device during a heating operation in the refrigeration cycle apparatus shown in FIG. 20. Although the refrigeration cycle apparatus in accordance with the present embodiment has basically the same configuration as that of the refrigeration cycle apparatus shown in FIGS. 1 to 3, it is different from the refrigeration cycle apparatus shown in FIGS. 1 to 3 in that it includes three outdoor heat exchangers 3*a* to 3*c* as an outdoor heat exchanger, and in the arrangement of flow path switching device 12. A specific description will be given below.

The refrigeration cycle apparatus shown in FIGS. 20 to 22 includes outdoor heat exchangers 3*a* to 3*c* divided into three, relative to the configurations of the refrigeration cycle apparatuses in accordance with the first to six embodiments described above. When the refrigeration cycle apparatus uses heat exchangers 3*a* to 3*c* divided into at least three or more as an outdoor heat exchanger as shown in FIG. 20, the refrigeration cycle apparatus can have the same function as those of the refrigeration cycle apparatuses in accordance with the first to six embodiments described above, by arranging first port I, second port II, and third port III of flow path switching device 12 as shown in FIG. 20. Specifically, third outdoor heat exchanger 3*c* is connected to distribution device 10*a* via pipes 266 and 206. Further, outdoor heat exchanger 3*c* is connected with four-way valve 2*a* via pipes 267 and 247. Outdoor heat exchanger 3*a* is also connected with four-way valve 2*a* via pipes 207 and 247.

<Operation and Function/Effect of Refrigeration Cycle Apparatus>

The operation of the refrigeration cycle apparatus in accordance with the present embodiment is basically the same as that of the refrigeration cycle apparatus shown in FIGS. 1 to 3, and the same effect can be obtained. That is, during the cooling operation, second port II and third port III of flow path switching device 12 are connected as shown in FIG. 21, and refrigerant flows in a direction indicated by dotted-line arrows in FIG. 20. Further, during the heating operation, second port II and first port I of flow path switching device 12 are connected as shown in FIG. 22, and the refrigerant flows in a direction indicated by solid-line arrows in FIG. 20. Thus, the first to six embodiments are also applicable to a configuration in which an outdoor heat exchanger is divided into a plurality of two or more outdoor heat exchangers.

Eighth Embodiment

<Configuration of Refrigeration Cycle Apparatus>

Figure 23:
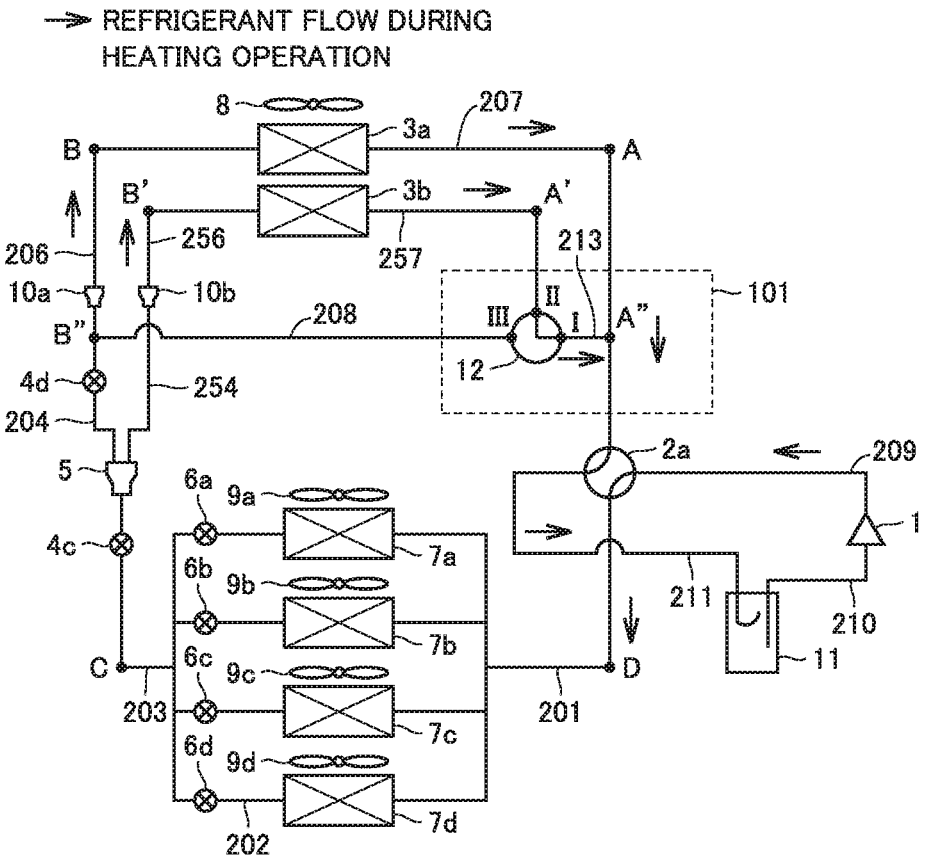
FIG. 23 is a schematic view showing a refrigerant flow during a heating operation in a refrigeration cycle apparatus in accordance with an eighth embodiment of the present invention.

FIG. 23 is a schematic view showing a refrigeration cycle apparatus in accordance with the present embodiment. Although the refrigeration cycle apparatus in accordance with the present embodiment has basically the same configuration as that of the refrigeration cycle apparatus shown in FIGS. 1 to 3, it is different from the refrigeration cycle apparatus shown in FIGS. 1 to 3 in the arrangement of expansion valves 4*c* and 4*d*. A specific description will be given below.

In the refrigeration cycle apparatus shown in FIG. 23, expansion valve 4*c* is arranged upstream of branch portion 5 (at some point in pipe 203) in the heating operation. Further, expansion valve 4*d* is arranged at the same position as that of expansion valve 4*a* in FIG. 1. It should be noted that, instead of expansion valve 4*d*, another openable and closable mechanism such as a solenoid valve may be arranged. In addition, expansion valve 4*b* shown in FIG. 1 is not arranged. Branch portion 5 is directly connected to distribution device 10*b* by pipe 254.

<Operation and Function/Effect of Refrigeration Cycle Apparatus>

The operation of the refrigeration cycle apparatus in accordance with the present embodiment is basically the same as that of the refrigeration cycle apparatus shown in FIGS. 1 to 3, and the same effect can be obtained. That is, during the heating operation, basically the same function and effect as those of the refrigeration cycle apparatus shown in FIG. 1 can be obtained by setting expansion valve 4*c* in an opened state and operating four-way valve 2*a* and flow path switching device 12 as in the refrigeration cycle apparatus shown in FIG. 1. Further, during the cooling operation, basically the same function and effect as those of the refrigeration cycle apparatus shown in FIG. 2 can be obtained by setting expansion valve 4*d* in a closed state, setting expansion valve 4*c* in an opened state, and operating four-way valve 2*a* and flow path switching device 12 as in the refrigeration cycle apparatus shown in FIG. 2.

In addition, in each of the embodiments described above, flow path switching device 12 may be configured such that second port II switches between the state in which second port II is connected to first port I and the state in which second port II is connected to third port III, based on at least one selected from the group consisting of an operation condition of compressor 1, a refrigerant temperature in indoor heat exchangers 7*a* to 7*d* as the first heat exchanger, a refrigerant temperature in outdoor heat exchangers 3*a*, 3*b*, 3*c* as the second heat exchanger, and an operation mode of the refrigeration cycle apparatus (for example, the cooling operation and the heating operation).

In addition, in each of the embodiments described above, expansion valves 4*a*, 4*b*, 4*c*, 4*d* are opened/closed in accordance with switching in flow path switching device 12 to switch between the refrigerant flow paths during the cooling operation and the refrigerant flow paths during the heating operation. However, each of the embodiments is not limited to that configuration. For example, a configuration not including expansion valves 4*a*, 4*b*, 4*c*, 4*d* may be adopted. In this case, for example, a mechanism for switching connection among pipes 203, 204, and 254 may be provided to branch portion 5, and thereby connection states among pipes 203, 204, and 254 within branch portion 5 may be switched in accordance with switching in flow path switching device 12.

Although the embodiments of the present invention have been described above, it is also possible to modify the embodiments described above in various manners. Further, the scope of the present invention is not limited to the embodiments described above. The scope of the present invention is defined by the scope of the claims, and is intended to include any modifications within the scope and meaning equivalent to the scope of the claims.

INDUSTRIAL APPLICABILITY

The refrigeration cycle apparatus in accordance with one embodiment of the present invention is applicable to, for example, a heat pump apparatus, a hot-water supply apparatus, a refrigeration apparatus, and the like.

The invention claimed is:

1. A refrigeration cycle apparatus, comprising a refrigerant circuit which includes a compressor, a first heat exchanger, an expansion valve, and a second heat exchanger, and in which refrigerant circulates, the second heat exchanger including a first refrigerant flow path and a second refrigerant flow path, the first refrigerant flow path and the second refrigerant flow path being connected in parallel to the first heat exchanger via a branch portion, the first refrigerant flow path including a first end portion, and a second end portion located opposite to the first end portion, the refrigerant circuit further including a flow path switching device, a third refrigerant flow path connecting the first end portion and the compressor, and a fourth refrigerant flow path connecting the second end portion and the branch portion, the first refrigerant flow path and the second refrigerant flow path including one or more paths, respectively, a number of the paths of the first refrigerant flow path being larger than a number of the paths of the second refrigerant flow path, the flow path switching device including a first port connected with the third refrigerant flow path, a second port connected with the second refrigerant flow path, and a third port connected with the fourth refrigerant flow path, in the flow path switching device, the second port being configured to switch between a state in which the second port is connected to the first port and a state in which the second port is connected to the third port, the refrigerant circuit further including a connecting flow path that connects the third port to the fourth refrigerant flow path, the third port being connected to the fourth refrigerant flow path through the connecting flow path, without connecting via the first refrigerant flow path and the second refrigerant flow path, the refrigerant circuit further including a four-way valve located between the flow path switching device and the compressor, in the third refrigerant flow path, and the first heat exchanger being an indoor heat exchanger, and the second heat exchanger being an outdoor heat exchanger.

2. The refrigeration cycle apparatus according to claim 1, further comprising an on-off valve arranged between the branch portion and a connection point connected with the connecting flow path, in the fourth refrigerant flow path.

3. The refrigeration cycle apparatus according to claim 2, wherein the refrigeration cycle apparatus is operable in a first operation state in which the on-off valve is set in an opened state and the second port is connected to the first port in the flow path switching device.

4. The refrigeration cycle apparatus according to claim 2, wherein the refrigeration cycle apparatus is operable in a second operation state in which the on-off valve is set in a closed state and the second port is connected to the third port in the flow path switching device.

5. The refrigeration cycle apparatus according to claim 1, wherein, in the flow path switching device, the second port is configured to switch between the state in which the second port is connected to the first port and the state in which the second port is connected to the third port, based on at least one selected from the group consisting of an operation condition of the compressor, a refrigerant temperature in the first heat exchanger, a refrigerant temperature in the second heat exchanger, and an operation mode of the refrigeration cycle apparatus.

6. The refrigeration cycle apparatus according to claim 1, wherein the flow path switching device includes one or more openable and closable valves.

7. The refrigeration cycle apparatus according to claim 1, wherein the flow path switching device includes a three-way valve.

8. The refrigeration cycle apparatus according to claim 1, wherein the flow path switching device includes a four-way valve.

9. A refrigeration cycle apparatus, comprising:

a refrigerant circuit which includes a compressor, a first heat exchanger, an expansion valve, and a second heat exchanger, and in which refrigerant circulates, the second heat exchanger including a first refrigerant flow path and a second refrigerant flow path, the first refrigerant flow path and the second refrigerant flow path being connected in parallel to the first heat exchanger via a branch portion, the first refrigerant flow path including a first end portion, and a second end portion located opposite to the first end portion, the refrigerant circuit including a flow path switching device, a third refrigerant flow path connecting the first end portion and the compressor, and a fourth refrigerant flow path connecting the second end portion and the branch portion, the first refrigerant flow path and the second refrigerant flow path including one or more paths, respectively, a number of the paths of the first refrigerant flow path being larger than a number of the paths of the second refrigerant flow path, the flow path switching device including a first port connected with the third refrigerant flow path, a second port connected with the second refrigerant flow path, and a third port connected with the fourth refrigerant flow path, in the flow path switching device, the second port being configured to switch between a state in which the second port is connected to the first port and a state in which the second port is connected to the third port, and the first heat exchanger being an indoor heat exchanger, and the second heat exchanger being an outdoor heat exchanger, wherein:

the second refrigerant flow path includes a third end portion, and a fourth end portion located opposite to the third end portion, the refrigerant circuit includes a fifth refrigerant flow path connecting the third end portion and the second port, and a sixth refrigerant flow path connecting the fourth end portion and the branch portion, one of the first refrigerant flow path and the second refrigerant flow path includes a plurality of flow paths parallel to each other, and the refrigerant circuit includes a distributor connecting the plurality of flow paths in the one of the first refrigerant flow path and the second refrigerant flow path, with the fourth refrigerant flow path or the sixth refrigerant flow path, and a hollow header connecting the plurality of flow paths in the one of the first refrigerant flow path and the second refrigerant flow path, with the third refrigerant flow path or the fifth refrigerant flow path.

10. The refrigeration cycle apparatus according to claim 1, wherein the second refrigerant flow path includes a third end portion, and a fourth end portion located opposite to the third end portion, the refrigerant circuit includes a fifth refrigerant flow path connecting the third end portion and the second port, and a sixth refrigerant flow path connecting the fourth end portion and the branch portion, one of the first refrigerant flow path and the second refrigerant flow path includes a plurality of flow paths parallel to each other, the refrigerant circuit includes a first hollow header connecting the plurality of flow paths in the one of the first refrigerant flow path and the second refrigerant flow path, with the fourth refrigerant flow path or the sixth refrigerant flow path, and a second hollow header connecting the plurality of flow paths in the one of the first refrigerant flow path and the second refrigerant flow path, with the third refrigerant flow path or the fifth refrigerant flow path.

11. The refrigeration cycle apparatus according to claim 1, wherein the refrigerant circuit includes a gas-liquid separator connected with the first heat exchanger and the branch portion, and a seventh refrigerant flow path connecting the gas-liquid separator and the third refrigerant flow path.

12. The refrigeration cycle apparatus according to claim 1, wherein the refrigerant circuit includes a liquid-liquid heat exchanger connected with the branch portion via an eighth refrigerant flow path, and connected with the first heat exchanger, a ninth refrigerant flow path connecting the eighth refrigerant flow path and the liquid-liquid heat exchanger, and a tenth refrigerant flow path connecting the liquid-liquid heat exchanger and the third refrigerant flow path, to pass the refrigerant having flowed into the liquid-liquid heat exchanger via the ninth refrigerant flow path to the third refrigerant flow path.

13. The refrigeration cycle apparatus according to claim 1, further comprising:

a first fan configured to blow air to the first heat exchanger; and a second fan configured to blow air to the second heat exchanger.

* * * * *